US011178931B2

(12) United States Patent
McCashin et al.

(10) Patent No.: US 11,178,931 B2
(45) Date of Patent: Nov. 23, 2021

(54) PROTECTIVE HELMET

(71) Applicant: CONCRETE DISTRIBUTION, INC., Gardena, CA (US)

(72) Inventors: Daniel Andrew McCashin, Manhattan Beach, CA (US); Christopher Michael Terins, Redondo Beach, CA (US)

(73) Assignee: CONCRETE DISTRIBUTION, INC., Gardena, CA (US)

( * ) Notice: Subject to any disclaimer, the term of this patent is extended or adjusted under 35 U.S.C. 154(b) by 8 days.

(21) Appl. No.: 16/512,309

(22) Filed: Jul. 15, 2019

(65) Prior Publication Data

US 2019/0335839 A1 Nov. 7, 2019

Related U.S. Application Data

(63) Continuation of application No. 15/678,099, filed on Aug. 15, 2017, now Pat. No. 10,349,698.
(Continued)

(51) Int. Cl.
*A42B 3/22* (2006.01)
*A42B 3/04* (2006.01)
(Continued)

(52) U.S. Cl.
CPC ..... *A42B 3/221* (2013.01); *A42B 3/003* (2013.01); *A42B 3/0406* (2013.01); *A42B 3/08* (2013.01); *A42B 3/22* (2013.01); *A42B 3/283* (2013.01)

(58) Field of Classification Search
CPC .. A42B 3/221; A42B 3/22; A42B 3/08; A42B 3/185
See application file for complete search history.

(56) References Cited

U.S. PATENT DOCUMENTS 3,239,842 A * 3/1966 Marchello ..... A42B 3/16 2/422
3,774,239 A 11/1973 Kotzar
(Continued)

FOREIGN PATENT DOCUMENTS

GB 2501707 A * 11/2013 ..... A61F 9/029

OTHER PUBLICATIONS

S1 Life Helmet w/Visor. Website. S-One Helmet Co., (Jan. 19, 2016), URL: http://s-onederby.blogspot.com/2016/01/s1-lifer-helmet-w-visor.html, (Oct. 3, 2017), XP055467510.
(Continued)

*Primary Examiner* — Tajash D Patel
(74) *Attorney, Agent, or Firm* — Feurguson Case Orr Paterson

(57) ABSTRACT

A protective helmet including a visor attached to the external sides of the helmet shell. The shell includes substantially flat mount surfaces on each side which correspond with substantially flat portions on the respective ends of the visor. A fastener hole on the shell aligns with an access hole on the visor so that the two elements can be releasably fastened. The access hole provides space for a fastener to protrude out from the surface of the shell, allowing the visor to sit flush against the shell when fastened together. The helmet may include chin straps which are attached to the inner surface of the shell. The helmet may also include a catch strip on the front of the visor which protrudes from the visor such that it can prevent a cloth helmet cover (sometimes used in games such as Roller Derby) from easily sliding off the helmet.

11 Claims, 6 Drawing Sheets

Related U.S. Application Data

(60) Provisional application No. 62/375,861, filed on Aug. 16, 2016.

(51) Int. Cl.

| | |
|---|---|
| ***A42B 3/00*** | (2006.01) |
| ***A42B 3/08*** | (2006.01) |
| ***A42B 3/28*** | (2006.01) |

(56) References Cited

U.S. PATENT DOCUMENTS

| | | | | | |
|---|---|---|---|---|---|
| 4,229,836 | A | | 10/1980 | Stinger | |
| 4,653,123 | A | * | 3/1987 | Broersma | A42B 3/0493 2/171.3 |
| 4,689,836 | A | * | 9/1987 | Vitaloni | A42B 3/326 2/411 |
| 5,365,615 | A | | 11/1994 | Piszkin | |
| 6,237,162 | B1 | | 5/2001 | Gill | |
| 8,375,462 | B2 | | 2/2013 | Lamanna | |
| 2017/0042274 | A1 | * | 2/2017 | Tatomir | A42B 3/221 |

OTHER PUBLICATIONS

International Search Report and Written Opinion for Application No. PCT/US2017/047225; dated Oct. 30, 2017.

Terins, Chris (Jan. 19, 2016) S1 Lifer Helmet with Visor; http://sonederby.blogspot.com/2016/001/s1-lifer-helmet-w-visor.html.

* cited by examiner

PROTECTIVE HELMET

RELATED APPLICATIONS

This application is a continuation of U.S. application Ser. No. 15/678,099, filed on 15 Aug. 2017, which claims the benefit of U.S. Provisional Application No. 62/375,861, filed on 16 Aug. 2016. The applications referred to in this paragraph are hereby incorporated by reference as if set forth fully herein.

BACKGROUND OF THE INVENTION

Field of the Invention

Embodiments of the present invention relate to protective helmets or head gear and, more specifically, to helmets that may be used in skate sports.

DETAILED DESCRIPTION OF THE INVENTION

Embodiments of the present invention include helmets and protective head gear that are particularly well-suited for skate sports, especially contact skate sports such as roller derby.

The present invention is described herein with reference to certain embodiments, but it is understood that the invention can be embodied in many different forms and should not be construed as limited to the embodiments set forth herein. In particular, embodiments of the present invention are described below in regards to certain helmet systems that can be worn by users during skate sports and competitions.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

Figure 1:
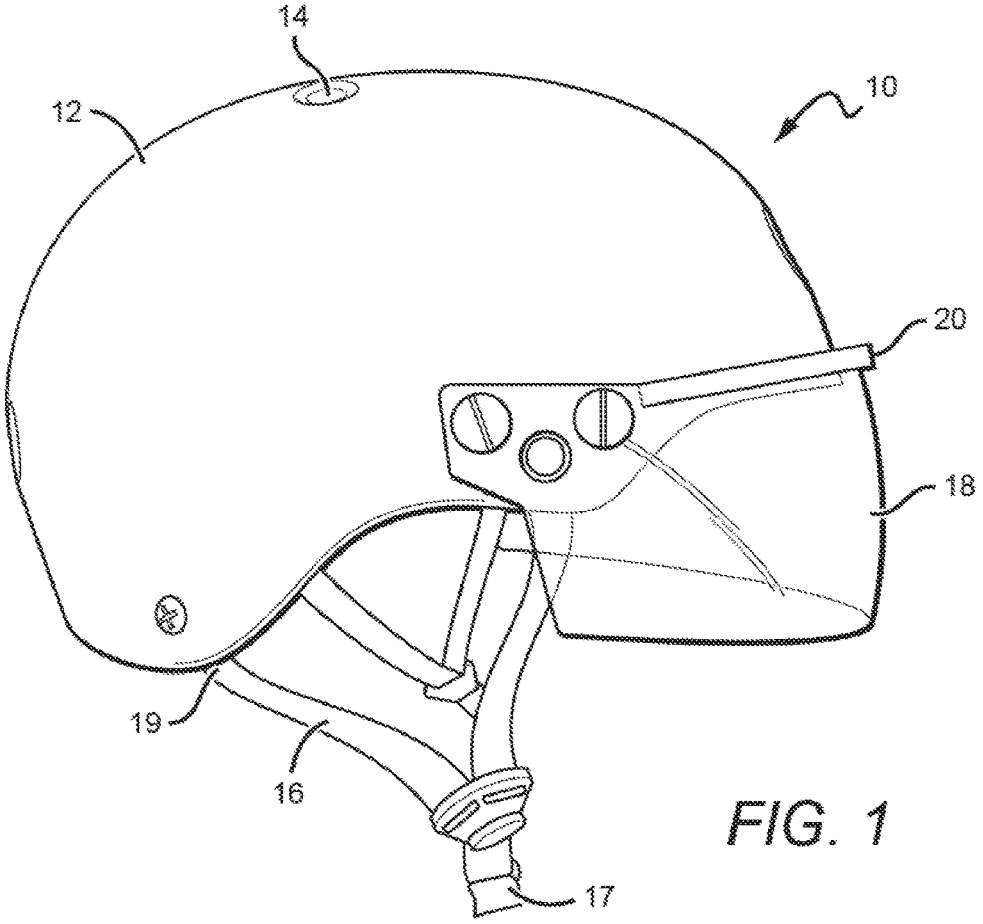
FIG. 1 is a right side elevation view of a helmet according to an embodiment of the present invention.

FIG. 1 is a right side elevation view of a helmet 10 according to an embodiment of the present invention. The helmet 10 generally comprises an outer shell 12 made from durable plastics or other hard/semi-hard materials that are capable of absorbing repeated impacts. The shell 12 may have several holes 14 or slits cut out of it to provide ventilation, allowing air to enter the shell and cool the user's head. Chin straps 16 may be attached to the inside or the outside of the shell. Each of the straps 16 may comprise a joining portion 17 at one end and at least one attachment portion 19 at another end. The joining portions 17 are configured to join under a user's chin. The chin straps 16 allow the user to tighten the helmet over the head for a snug fit. In this particular embodiment, the attachment portions 19 are fastened to inside of the shell 12. A visor 18 is attached to the external sides of the shell 12. The visor 18 spans the front of the helmet 10 to protect the user's face. A catch strip 20 runs along the top portion of the visor 18, spanning at least a portion of the visor 18.

Figure 2:
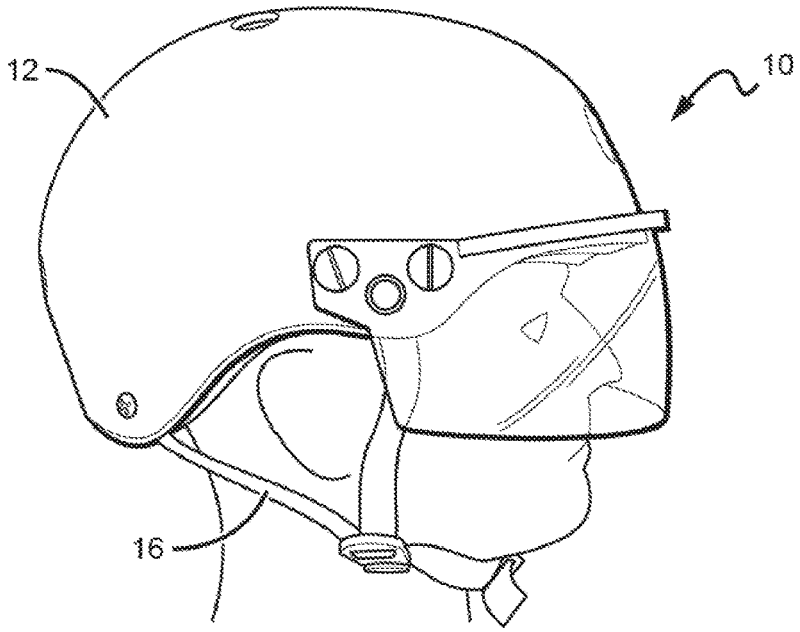
FIG. 2 is a right side elevation view of a helmet according to an embodiment of the present invention.

FIG. 2 is a side view of the helmet 10 shown on a display head in order to show how the helmet 10 fits. As shown, the chin straps 16 can be fastened underneath the user's chin for a snug fit. The chin straps 16 may be tightened and loosened as necessary. Many types of known releasable fastening mechanisms may be used.

Figure 3:
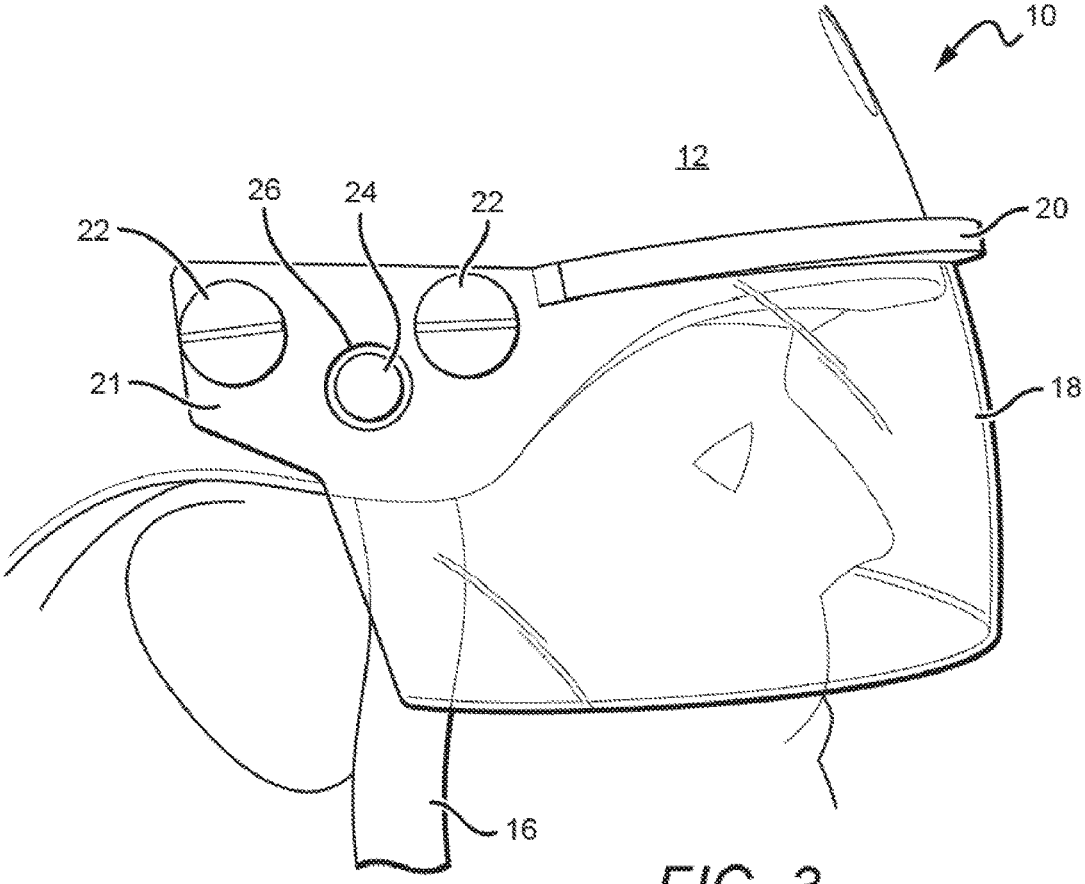
FIG. 3 is a close-up view of a portion of the right side of a helmet according to an embodiment of the present invention.

FIG. 3 is a close-up side view of the visor 18 where it is fastened to the shell 12. End regions 21 may comprise a flat portion to correspond with a substantially flat mount surface on the shell 12, as discussed in more detail with reference to FIG. 13. In this embodiment, the visor 18 is releasably fastened to the shell with two thumb screws 22 on each side so that it can be easily removed for cleaning, repair, or replacement. A strap rivet 24 may be used to connect the chin straps 16 to the interior of the shell 12. In this embodiment, an access hole 26 is cut out of the visor 18 to allow the strap rivet 24 to be tightened, loosened, or removed so that the chin straps 16 can be removed if necessary. Here, the strap rivet 24 is sunk with respect to the visor 18, but may also be sunk with respect to the shell 12 to provide smooth surface. The access hole 26 in the visor 18 also allows the visor 18 to sit flush against the shell, or at least very close to it, as the strap rivet 24 is allowed to protrude slightly from the shell 12 without pressing against the visor 18.

The catch strip 20 is attached to the front side of the visor 18, opposite the shell 12. The catch strip 20 is attached to a top area of the visor 18 such that the catch strip 20 is not in a field of vision of a user when wearing the helmet 10.

The catch strip 20 is multifunctional. In one particular usage, namely roller derby, some contestants are required to wear a cloth helmet cover (not shown) bearing an indicative symbol (e.g., a star, a stripe, etc.) over the helmet to identify a particular player position. These helmet covers, sometimes referred to colloquially as "panties," may be passed during the game. In one aspect, the catch strip 20 functions to hold the helmet cover in place during the action of the game. Thus, the catch strip 20 may be made of a foam, rubber, or plastic material, or the like, that is capable of gripping the inside of a helmet cover, preventing it from sliding off.

The catch strip 20 may be fastened to the visor 18 using an adhesive or by other means. In this embodiment, the catch strip 20 is fastened to the outer surface of the visor 18 to allow air to flow in the small gap between the shell 12 and the visor 18. In order to provide enough resistance to the helmet cover to prevent sliding, the catch strip 20 should have an appropriate thickness such that it protrudes a distance out from the visor outer surface, for example, between approximately 3-7 mm, with one suitable thickness being approximately 5 mm as shown in FIG. 3. Other thicknesses may also be used.

The catch strip 20 may also function in other ways. For example, in another aspect, the catch strip 20 provides a surface for holding the visor 18 prior to and during installation without getting the transparent portions of the visor 18 dirty with fingerprints or smudges. Additionally, the catch strip 20 may provide additional padding for face-first falls and collisions. Other functions are also possible.

Figure 4:
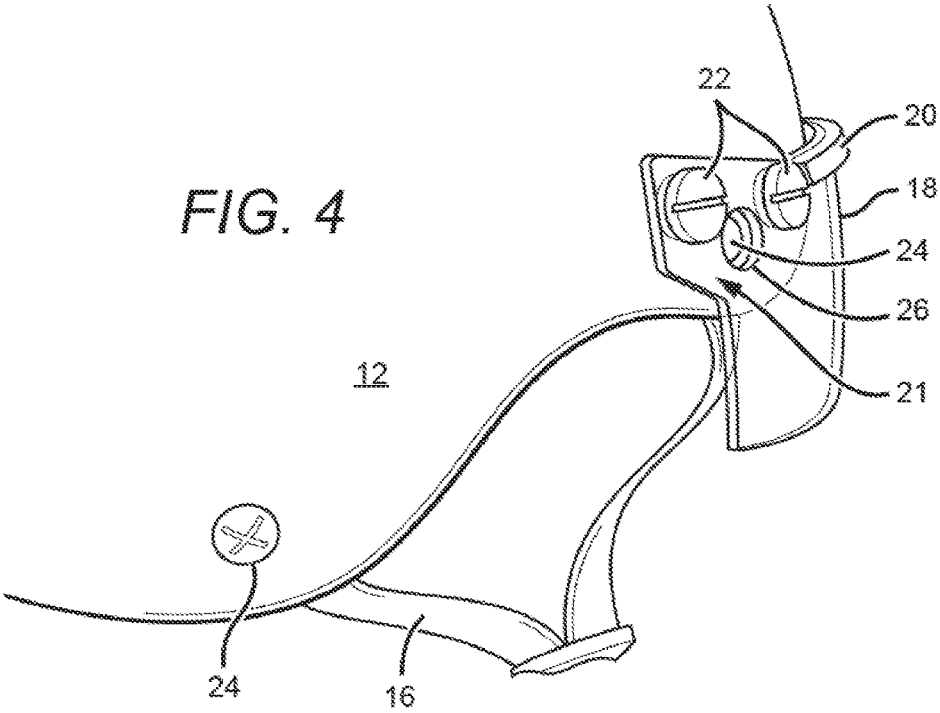
FIG. 4 is a close-up view of the back right side of a helmet according to an embodiment of the present invention.

FIG. 4 shows the helmet 10 from a back right side perspective view. Both strap rivets 24 on the right side of the helmet 10 are shown from this angle. The left side includes a mirror image correspondence with respect to the thumb screws 22 and the strap rivets 24. The strap rivets 24 enable the chin straps 16 to be fastened to the inner surface of the shell 12, allowing the chin straps 16 to be safely installed at the factory so that the helmet can be certified for a particular use when shipped to a retailer or directly to a customer. Here, the front strap rivet 24 can be seen through the access hole 26 of the visor 18.

Figure 5:
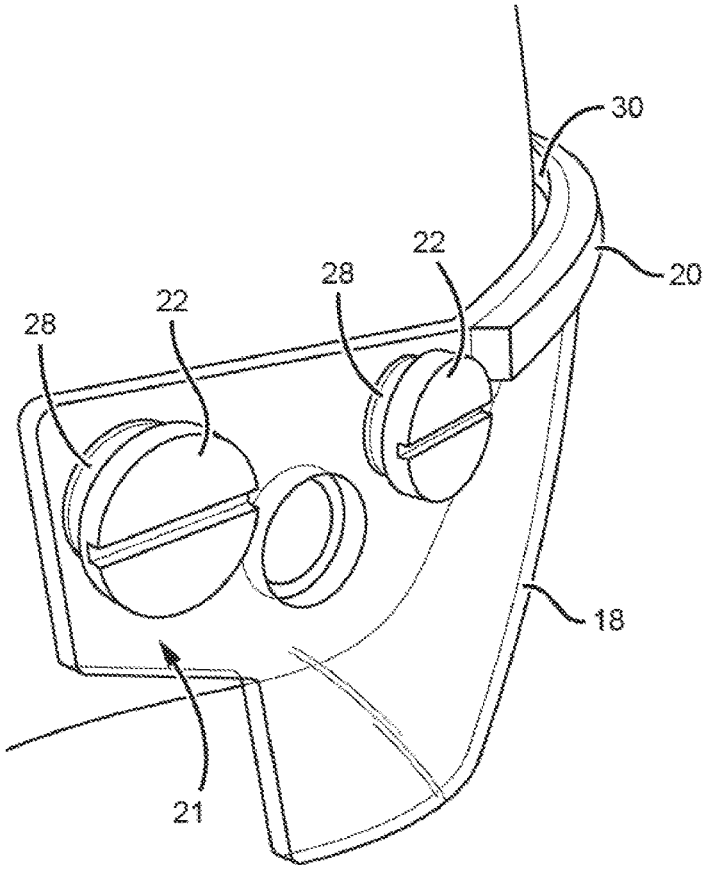
FIG. 5 is a detailed close-up view of the back right side of a helmet according to an embodiment of the present invention.

FIG. 5 shows a detailed close-up of the visor 18. The edge of the visor 18 may be connected to the shell 12 on both sides with the thumb screws 22 as shown, or it may be connected by other means, such as snaps, adhesives, or the like. In this embodiment, washers 28 function as stand-offs to keep the visor 18 from laying flush against the shell 12. This prevents moisture from getting trapped between the visor 18 and the shell 12 and promotes air flow between the two elements. The washers also serve to provide a buffer between the shell 12 and the visor 18 so that the visor 18 can be tightened against the shell 12 without damaging either element. Catch strip 20 is shown running along the top front edge of the visor 18. In this view the gap 30 between the visor 18 and the shell 12 is visible.

Figure 6:
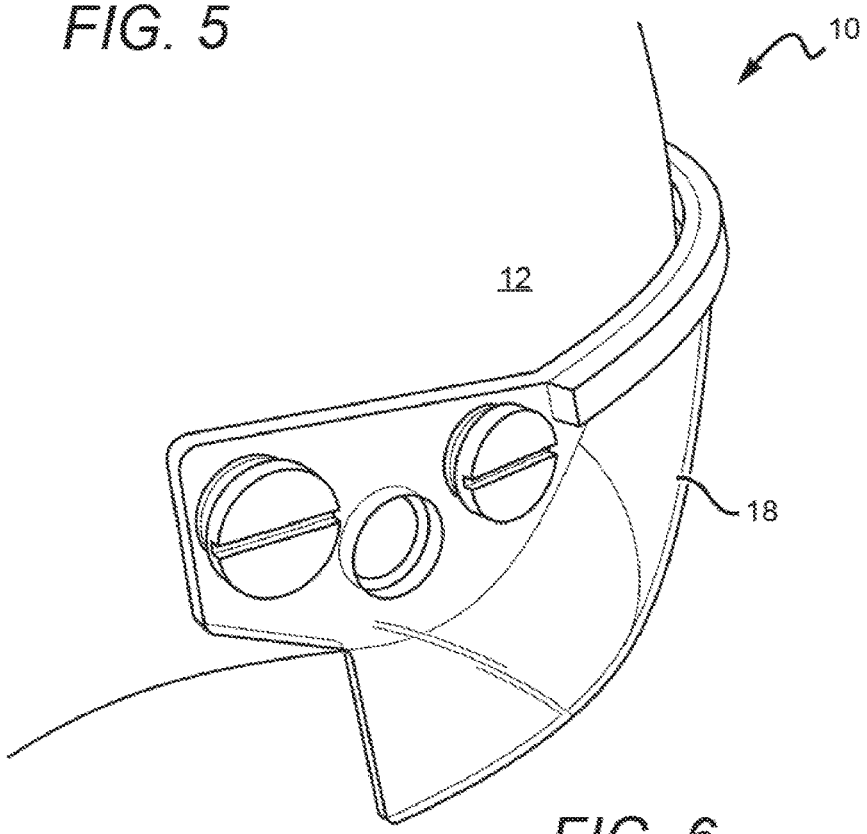
FIG. 6 is a detailed close-up view of the front right side of a helmet according to an embodiment of the present invention.

FIG. 6 is another view of the front right portion of the helmet 10 where the visor 18 is connected to the shell 12.

Figure 7:
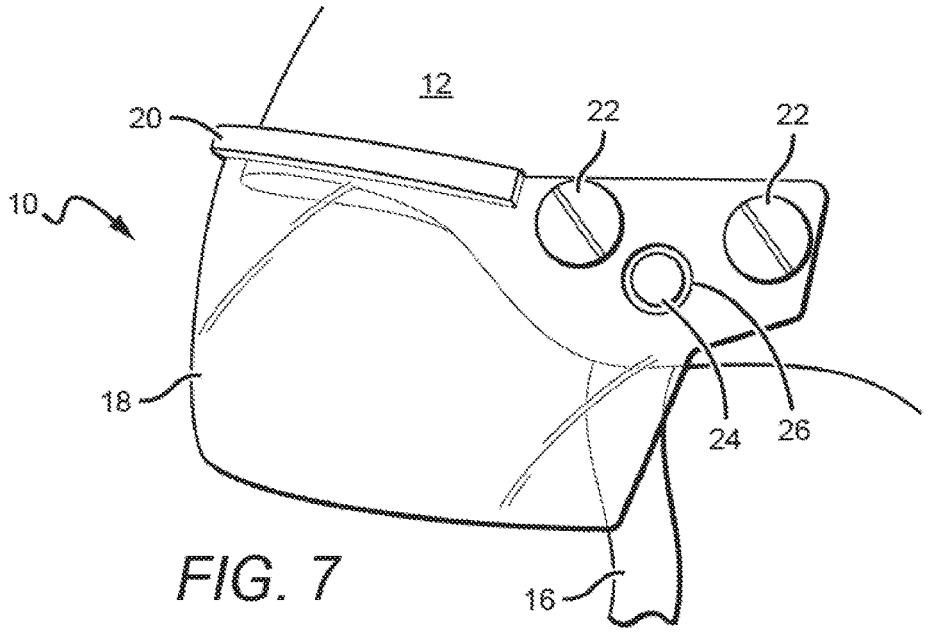
FIG. 7 is a detailed close-up view of the front left side of a helmet according to an embodiment of the present invention.

FIG. 7 is a front left side view of the helmet 10. In this embodiment, the elements on the left side of the helmet have mirror-image correspondence with the elements on the right side of the helmet 10 shown in FIGS. 1-6 and, thus, are indicated with the same reference numerals.

Figure 8:
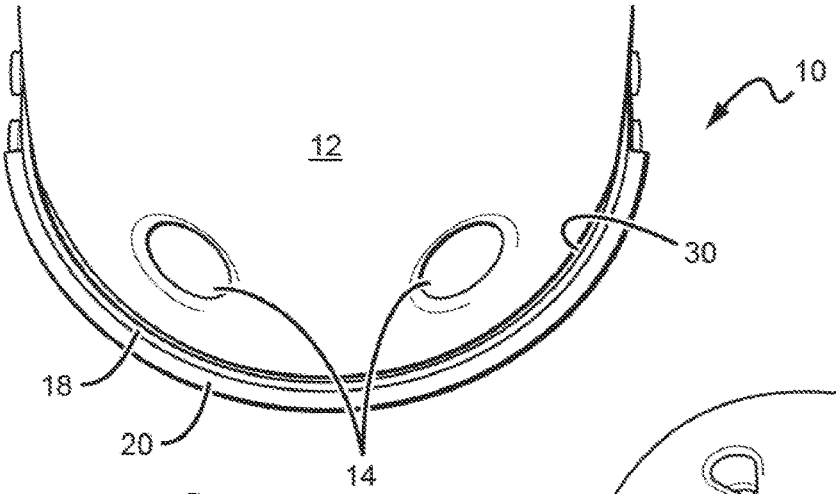
FIG. 8 top perspective view of the front of a helmet according to an embodiment of the present invention.

FIG. 8 is a top front view of the helmet 10. Holes 14 on the front side of the shell 12 are shown in this view. The catch strip 20 and the visor 18 are shown connected to the shell 12 with the gap 30 there between.

Figure 9:
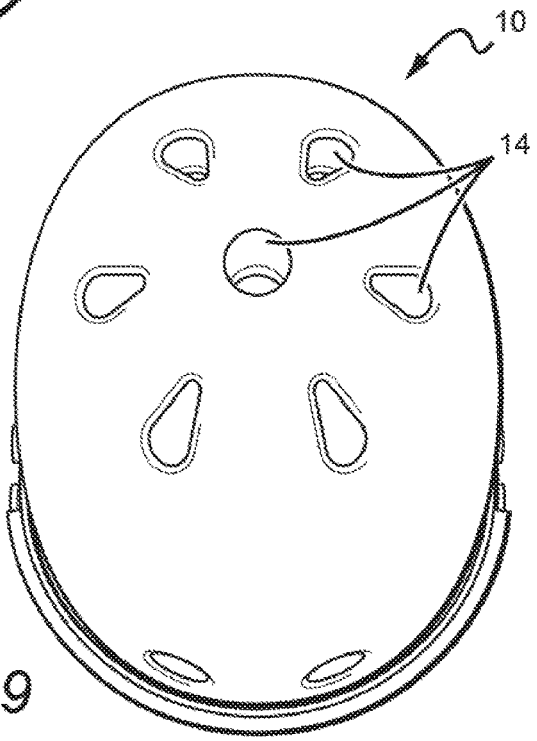
FIG. 9 is a top plan view of a helmet according to an embodiment of the present invention.

FIG. 9 is a top view of the helmet 10 with more of the top side air holes 14 shown.

Figure 10:
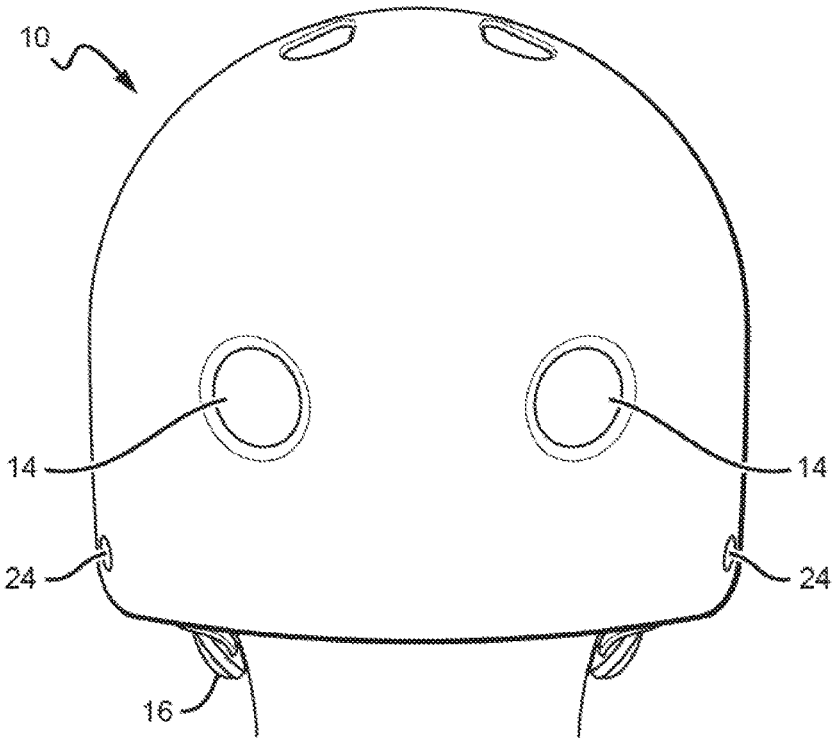
FIG. 10 is a back elevation view of a helmet according to an embodiment of the present invention.

FIG. 10 is a back side view of the helmet 10 shown on a display head. Air holes 14 on the back side of the helmet 10 are shown as well as the back strap rivets 24 as best shown in FIG. 4.

Figure 11:
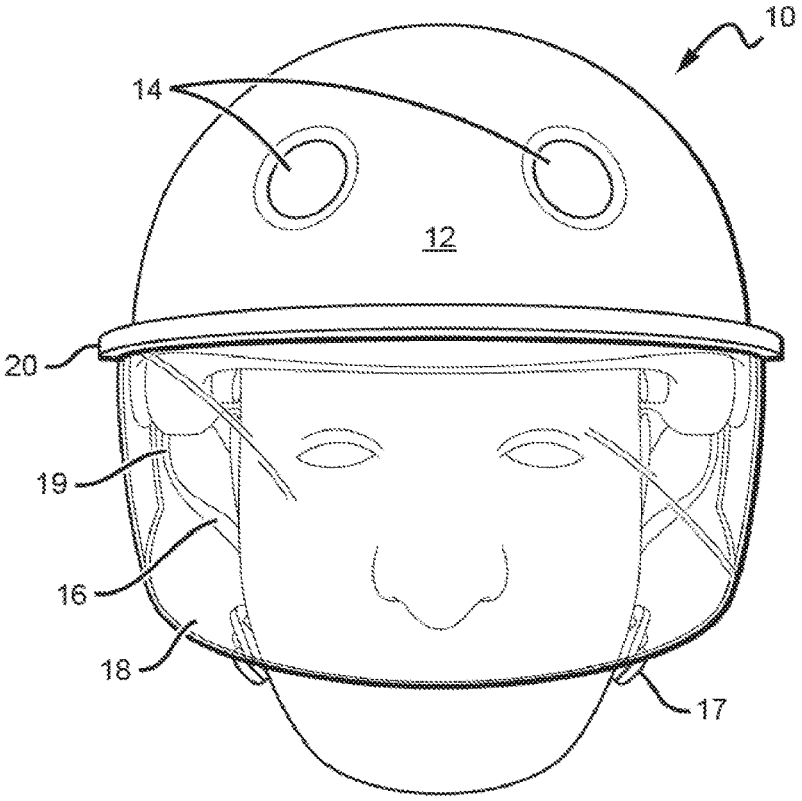
FIG. 11 is a front elevation view of a helmet according to an embodiment of the present invention.

FIG. 11 is another front side view of the helmet 10 shown on a display head.

Figure 12:
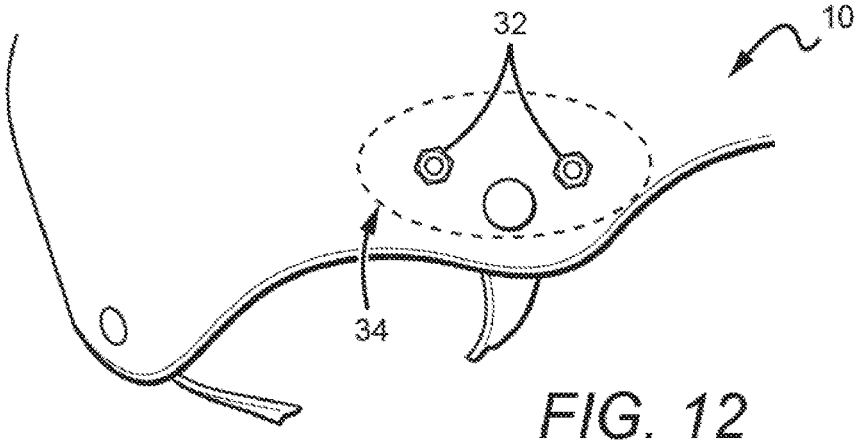
FIG. 12 is a right side elevation view of a helmet according to embodiment of the present invention with the visor removed.

FIG. 12 is a right side view of the helmet 10 with the visor 18 and thumb screws 22 removed to expose mounted screw holes 32. Here, the screw holes 32 are implemented with inlaid hardware which is shaped to receive the threaded portions of the thumb screws 22 when the visor 18 is mounted to the shell 12. Although the shell 12 has a generally rounded shape, a portion of the shell 12 around the screw holes 32 has been flattened out to provide a substantially flat mount surface 34 (roughly within dashed line) where a corresponding substantially flat portion of the visor 18 may be mounted to the shell 12, eliminating the need to angle screw holes on a shell and/or a visor to accommodate a curved mount surface. This structure may reduce complexity in the manufacturing process and facilitate assembly. The dashed line only roughly defines the flat mount surface 34 area. The flat mount surface 34 area may not be limited to the area within the dashed line or it may be confined by but not coextensive with the dashed line. In this manner, the dashed line is intended for illustrative purposes only; it is not meant to be limiting in any way.

Figure 13:
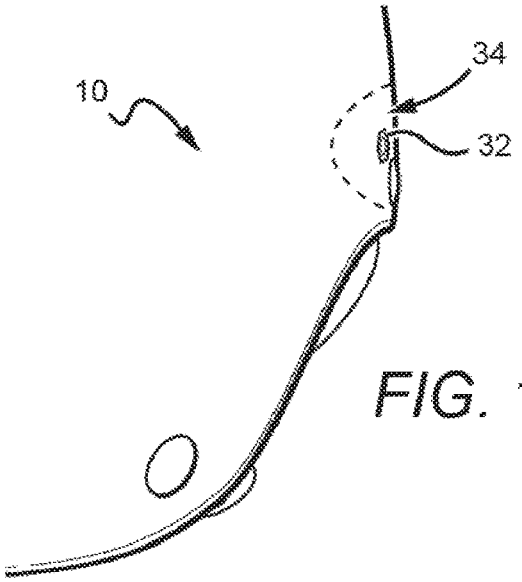
FIG. 13 is a back right perspective view of a portion of the helmet according to an embodiment of the present invention with the visor removed.

FIG. 13 shows a close-up view of the front right side of the helmet 10 with the visor 18 removed to reveal the screw hole 32. Substantially flat mount surface 34 is approximated by the dashed line as previously discussed.

Figure 14:
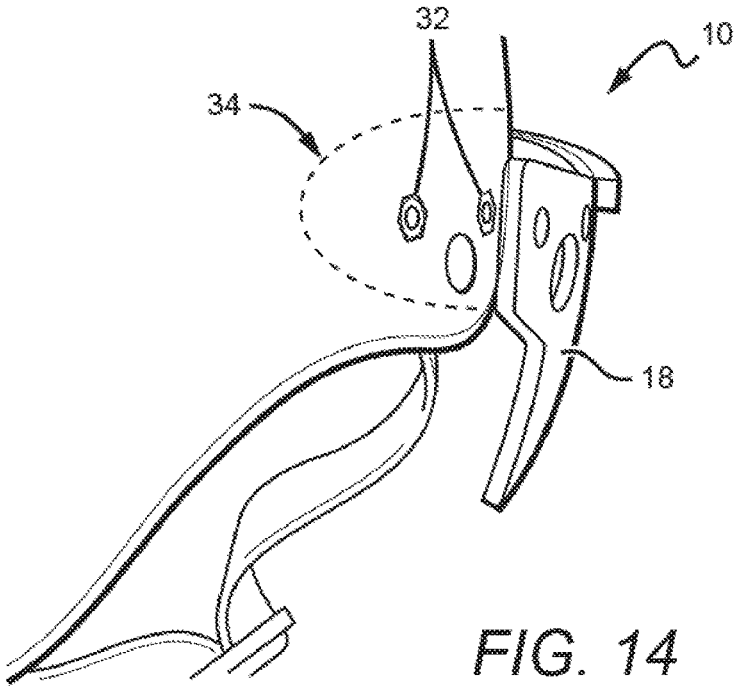
FIG. 14 is a front right perspective view of a portion of the helmet according to an embodiment of the present invention prior to attaching the visor.

FIG. 14 shows a close-up of the front right side of the helmet 10 with the visor 18 shown proximate to but not attached to the shell 12. A flat portion of the visor 18 corresponds to the flat mount surface 34 of the shell 12 to facilitate a flush connection at the mount point.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A helmet, comprising:

a generally round shell, said shell comprising a plurality of substantially flat mount surfaces, one of said mount surfaces on each side of said shell, each of said substantially flat mount surfaces comprising a fastener hole shaped to receive a fastener; and a generally curved translucent visor releasably fastened to the front of said shell, said visor comprising first and second end regions, each of said end regions comprising a substantially flat portion configured to align with a corresponding one of said mount surfaces of said shell, each of said end regions further comprising an access hole configured to align with said fastener hole of said shell such that said fastener is sunk with respect to said visor when said visor is fastened to said shell, allowing said substantially flat portions of said visor to sit flush against said substantially flat mount surfaces of said shell.

2. The helmet of claim 1, wherein said fastener is sunk with respect to said shell when said visor is fastened to said shell.

3. The helmet of claim 1, further comprising chin straps, each of said straps comprising a joining portion at one end and at least one attachment portion at another end, said joining portions configured to join under a user's chin, wherein at least one of said attachment portions is attached to an inner surface of said shell.

4. The helmet of claim 3, where a fastener protrudes through said fastener hole on said shell to attach said attachment portion of said straps to said inner surface of said shell.

5. The helmet of claim 1, said shell further comprising at least one mounted screw hole in each of said substantially flat mount surfaces of said shell.

6. The helmet of claim 5, said at least one mounted screw hole threaded to receive a screw.

7. The helmet of claim 5, said mounted screw hole comprising inlaid hardware threaded to receive a screw.

8. The helmet of claim 1, wherein said visor is attached to said shell with at least one thumb screw.

9. The helmet of claim 1, further comprising a catch strip on an outer surface of said visor.

10. The helmet of claim 9, said catch strip comprising a material that is capable of gripping a cloth helmet cover and wherein said cloth helmet cover is not attached to said catch strip when said cloth helmet cover is on said helmet.

11. The helmet of claim 3, wherein said attachment portions are attached to said shell using rivets.

* * * * *